United States Patent [19]

Bloore et al.

[11] 4,307,290

[45] Dec. 22, 1981

[54] ELECTRIC HEATING TAPES

[75] Inventors: Frederick W. Bloore; Peter H. Seaman, both of Wolverhampton, England

[73] Assignee: Hotfoil Limited, Wolverhampton, England

[21] Appl. No.: 48,148

[22] Filed: Jun. 13, 1979

[51] Int. Cl.[3] ..... H05B 3/34; H05B 3/54

[52] U.S. Cl. ..... 219/528; 219/541; 219/544; 219/549; 219/552; 338/22 R; 338/212

[58] Field of Search ..... 219/505, 510, 528, 541, 219/544, 548, 549, 552, 553; 338/22 R, 22 SD, 211, 212, 213, 214, 217, 218, 331; 29/611; 252/511; 174/DIG. 8; 13/25

[56] References Cited

U.S. PATENT DOCUMENTS

| | | | |
|---|---|---|---|
| 2,905,919 | 9/1959 | Lorch et al. | 338/214 X |
| 3,535,494 | 10/1970 | Armbruster | 219/528 |
| 3,757,088 | 9/1973 | Osborn | 219/549 X |
| 3,858,144 | 12/1974 | Bedard et al. | 338/22 R |
| 3,861,029 | 1/1975 | Smith-Johannsen et al. | 29/611 |
| 4,074,222 | 2/1978 | Kiyokawa et al. | 219/528 X |
| 4,086,559 | 4/1978 | Knippenberg et al. | 338/22 R |
| 4,177,376 | 12/1979 | Horsma et al. | 219/553 |

FOREIGN PATENT DOCUMENTS

| | | | |
|---|---|---|---|
| 2024579 | 1/1980 | United Kingdom | 219/528 |

*Primary Examiner*—Volodymyr Y. Mayewsky
*Attorney, Agent, or Firm*—Pearne, Gordon, Sessions, McCoy & Granger

[57] ABSTRACT

A heating tape comprising a pair of elongate electrodes embedded in a body of electrically conductive material wherein the highest current density in the effective current path between the electrodes as herein defined, is at a location spaced from and intermediate the electrodes.

6 Claims, 6 Drawing Figures

ELECTRIC HEATING TAPES

BACKGROUND OF THE INVENTION

1. Field of the Invention

This invention relates to electrically conductive heating tapes of the type, hereinafter referred to as the type described, comprising a pair of elongate electrodes embedded in a body of electrically conductive material such as silicone rubber or other elastomer having dispersed therein particles of conductive material such as carbon black.

The invention is particularly, but not exclusively, concerned with a heating tape as described in our copending U.S. application Ser. No. 907,415.

SUMMARY OF THE INVENTION

An object of the invention is to provide a heating tape of the type described above wherein electrical failure of the tape is avoided or is reduced.

According to one aspect of the invention we provide a heating tape of the type described wherein the highest current density in the effective current path between the electrodes, as herein defined, is at a location spaced from and intermediate the electrodes.

According to another aspect of the invention we provide a heating tape of the type described wherein the smallest cross-sectional dimension of the effective current path in a lateral cross section of the tape is at a location intermediate the electrodes.

In general the effective current path is bounded at the electrodes by a part of the electrode/body interface which has a portion which faces generally towards the other electrode and which is of a transverse extent substantially equal to one half of the total peripheral extent of the electrode/body interface.

In the case of a circular or substantially circular electrode the current path is bounded at the electrodes by a part of the electrode/body interface a normal to which extends in a direction which has a component extending towards the other electrode.

Said smallest cross sectional dimension is preferably not more than 60% of the transverse dimension of said part of the interface.

According to another aspect of the invention we provide a heating tape of the type described wherein the smallest cross sectional dimension of the body between the electrodes is smaller than the maximum effective cross sectional dimension of the electrodes.

The maximum effective cross sectional dimension of the electrode is, if the electrodes are of different size, the maximum cross sectional dimension of the smallest electrode. If the electrodes are of composite construction, for example, a cylindrical copper wire inner part in a tubular case of conductive rubber of higher conductivity than the body, the effective dimension is the sum of the diameter of the copper wire, Dw and the product of the total thickness Tc and the ratio of the electrical conductivity of the wire and case Cw, Cc. That is to say:

$$Dw + Tc\ (Cc/Cw)$$

said smallest cross sectional dimension of the body is preferably not more than 60% of the maximum effective cross sectional dimension of the electrodes.

Conventionally a heating tape of the type described is generally rectangular in lateral cross-section. We consider that when such tapes fail it is due to the carbon chains in the electrically conductive rubber adjacent the electrodes breaking down due to them carrying the most current since the smallest cross sectional dimension of the electrically conductive rubber and thus, the highest current density, in said lateral section is in the part of the rubber surrounding the electrodes.

A tape embodying the present invention avoids or reduces the problem of tape failure due to the above cause by locating the smallest cross-section dimension and hence the highest current density as specified above.

The tape may comprise in said lateral section a main body part of electrically conducting material and at each end thereof electrode surrounding parts of greater overall thickness than the main body part and which project transversely relative to the main body part on one side only of the main body part.

The electrode surrounding parts may be of generally circular external configuration in said cross section, one surface of the main body part being tangential to the circular electrode surrounding parts and the other surface of the main body part being parallel to and spaced from said one surface.

Alternatively the tape may include a non-conductive part located between the electrodes of such a configuration as to provide said reduced cross-sectional dimension part. Said part may be a non-conductive insert.

The tape may be of generally constant cross-sectional dimension in said lateral section between the electrodes and have an insert of glass fibre or silicone or other semi-flexible solid non-conductive material.

The insert may be generally rectangular in said lateral section and may be located so as to have a layer of conductive material on each side thereof transversely of said section.

In both this and the previous embodiment less conductive rubber is used than if the tape, except for the electrodes, comprised only rubber and hence production is facilitated as a longer length of tape may be made from a given mass of rubber.

In a further alternative there may be embedded within the tape between the electrodes one or more electrically conductive wires which are electrically insulated from the electrically conductive material of the body. This arrangement is advantageous when long tapes are used or where T-junctions are used since it can simplify the wiring of the power circuits.

In a still further alternative the tape may be of constant thickness in said lateral cross section and there being at least one groove formed in the rubber between the electrodes and extending in the transverse direction of the section so as to produce a region of reduced dimension in the electrically conductive material.

In one embodiment a single groove may be provided extending transversely inwardly from one side surface of the tape to a position adjacent the other side surface and spaced inwardly thereof.

In another embodiment a pair of opposite grooves may be formed one extending inwardly from each of the side surfaces to form a region of reduced thickness in the electrically conductive material between the bottom of the grooves.

In a further embodiment three grooves may be provided, two extending inwardly in a transverse direction of the section from one side surface and the other being located longitudinally between the first mentioned two grooves and extending inwardly in the transverse direction of the section from the other side surface to produce two regions of reduced dimension in a direction extending longitudinally of the lateral section between said other groove and each of the two first mentioned grooves.

BRIEF DESCRIPTION OF THE DRAWINGS

The invention will now be described in more detail with reference to the accompanying drawings wherein.

DESCRIPTION OF THE PREFERRED EMBODIMENTS

Figure 1:
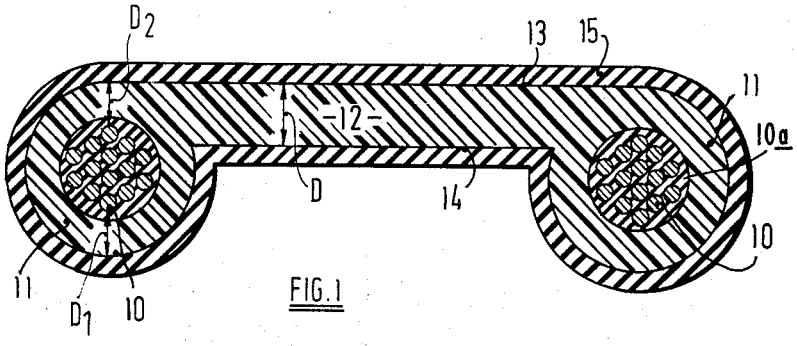
FIG. 1 is a lateral cross section through one embodiment of the invention.

Referring to FIG. 1, an electrically conductive tape is of indefinite length and in a lateral section taken at right angles to the longitudinal extent of the tape is of the configuration shown in FIG. 1. Thus in lateral section the tape comprises a pair of spaced metal wire electrodes 10 embedded in electrically conductive material, 11, 12 such as rubber and preferably rubber of the composition described in our co-pending U.S. application Ser. No. 907,415. The electrode surrounding parts 11 are of generally circular configuration and are connected together by a main body part 12 of the tape which is of constant thickness having a first side surface 13 which is planar and which extends tangentially to the outer surface of the electrode surrounding parts 11 and a second side surface 14 spaced a constant distance from the first mentioned side surface 13 in a direction transversely of said lateral section and hence also of planar configuration and which extends, as a result, chordally of the electrode surrounding parts 11. The whole tape is surrounded by a non-conductive outer sheath of rubber indicated at 15.

Thus, the main body part 12 of the tape is of less overall thickness than the overall thickness of the tape in the electrode surrounding parts 11. The resulting cross sectional dimension D of the electrically conductive material of the main body part is less than that D1+D2, of the electrically conductive material of the annular electrode surrounding part so that the part 12 acts as a current limiting region since the current density will be highest in this region.

In assessing the current density in this, and in the following embodiments, the effective current path is bounded at the electrode by the half cylindrical portion of the electrode/body interface facing the other electrode. Thus the current path has in all the embodiments, a transverse dimension of $\pi/2$ times the electrode diameter. In the case of substantially non-circular electrodes the transverse dimension of the part of the interface which bounds the current path can be approximated to one half of the total peripheral extent of the interface.

Preferably the dimension D is not more than 60% of said transverse dimension of the current path.

It is also to be noted that the dimension D is less than the effective maximum cross sectional dimension of the electrodes and is preferably not more than 60% of said effective maximum cross sectional dimension.

The effective maximum cross sectional dimension of the electrodes is, where there are electrodes of different diameter the maximum cross sectional dimension of the smallest electrode.

In the present embodiment, the electrodes comprise a wire electrode 10 which is embedded in a thin case **10*a*** of electrically conductive rubber which is of greater electrical conductivity than the electrode surrounding body part and is made of a material described in our co-pending U.S. Ser. No. 40,067. In this case the effective maximum cross sectional dimension of the electrode is equal to Dw+Tc (Cc/Cw) where Dw is the wire dimension, Tc is the total thickness of the case and Cc and Cw are, respectively, the conductivity of the case and wire.

Figure 2:
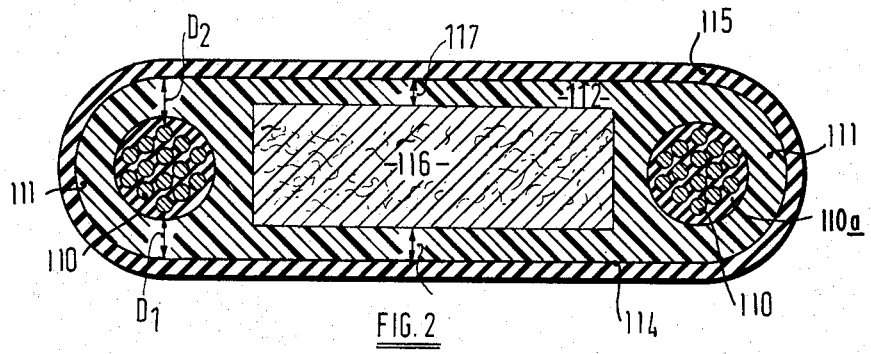
FIG. 2 is a similar section through another embodiment of the invention.

Referring to FIG. 2 the tape again comprises a pair of wire electrodes 110 embedded in electrically conductive material **110*a*, 111, 112 as described in the first embodiment in connection with the parts 10*a*, 11, 12 respectively. The main body part 112 is made, in this case, of the same overall thickness as electrode surrounding parts 111, which in this example are of semi-circular shape, and embedded in the main body part 112 is a non-electrically conductive insert 116 which in the present example is made of woven fibre glass cloth but which may be made of any semi-flexible, solid, non-conducting material such as fiberglass in other forms or silicone strip. The dimensions of the insert 116 are arranged so that the sum of the thicknesses of the electrically conductive material in the parts indicated at 117 is less than the sum of the thickness $D_1+D_2$ of the electrically conductive material in the electrode surrounding regions 111 so that the parts 117** act as a current limiting part of the tape.

It will be appreciated that the insert 116 may be of other configuration than that described hereinbefore so long as it has the effect of producing current limiting regions of reduced thickness compared with the thickness of the electrically conductive material in the parts 111.

The tape is again enclosed in an outer sheath of non-conductive material such as rubber as indicated at 115.

Figure 3:
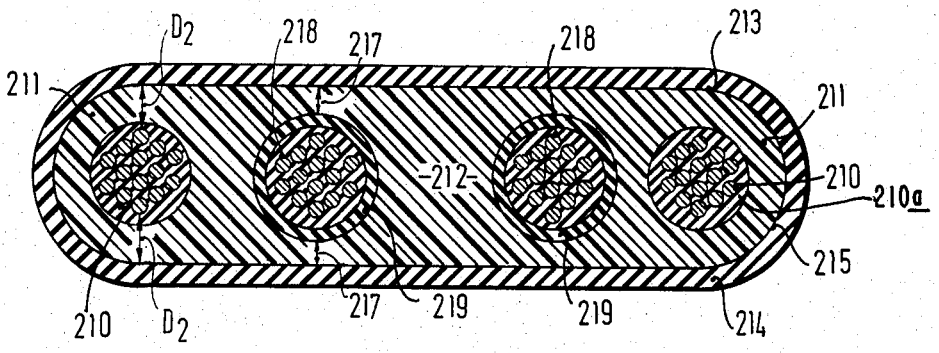
FIG. 3 is a similar view through a third embodiment of the invention.

Referring now to FIG. 3, in this example the heating tape again comprises two electrically conductive wires 210 embedded in electrically conductive rubber **110*a* of the same material as described in connection with 110*a* of FIG. 1. The wires 210 are embedded in an electrode surrounding part 211 of the rubber of semi-circular configuration and the main body of the tape comprises a part 212 of constant thickness having planar side surfaces 213 and 214**.

Embedded within the main body part 212 are two electrically conductive wires 218 which are surrounded by insulating material 219 so that they are insulated from the body of the tape 212. If desired, one or more than two such electrically conductive wires may be provided. The insulating material need not be of uniform thickness.

The wires 218 thus define reduced portions 217 of the electrically conductive rubber so that these act as current limiting portions in similar manner to the previously described embodiments, since the sum of the thickness of the portions 217 is less than the sum of the thickness $D_1+D_2$. The whole tape is again enclosed within the sheath of electrically insulating rubber indicated at 215.

Figure 4:
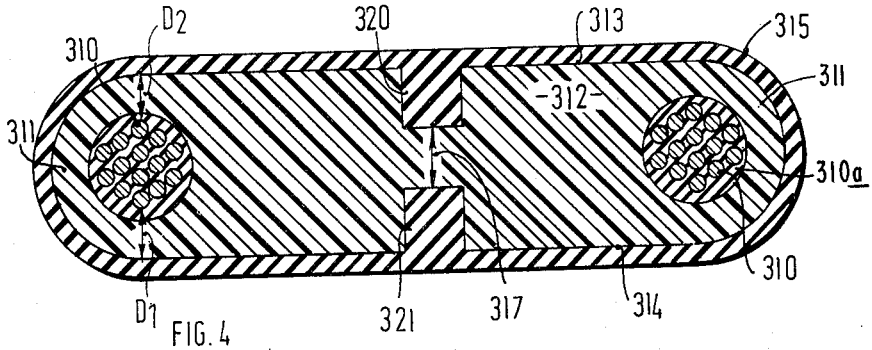
FIG. 4 is a similar view through a fourth embodiment of the invention.

Referring now to FIG. 4, in this embodiment the tape again comprises two electrically conductive wires 310 surrounded by electrically conductive rubber portions 310*a* and 311 of semi-circular configuration whilst the main body of the tape 312 again has generally planar side surfaces 313 and 314. The electrically conductive rubber of which the parts 310*a*, 311 and 312 are made is as described in connection with the previous embodiments.

In this embodiment a current limiting portion 317 is provided by the presence of grooves 320 and 321. The groove 320 extends inwardly of the tape from the side surface 313 in a direction transverse to the lateral section shown in FIG. 4 and does of course, extend in the longitudinal direction of the whole tape. The groove 320 is of limited extent in the longitudinal direction of the lateral section. A similar groove 321 extends in the transverse direction of the lateral section from the surface 314 and is aligned with the groove 320 in the longitudinal direction of that section thereby defining a current limiting part 317 therebetween of less thickness than the sum of the thickness $D_1$ and $D_2$.

The tape is again enclosed within a sheath of electrically insulating material 315 which also extends within the grooves 320 and 321.

Figure 5:
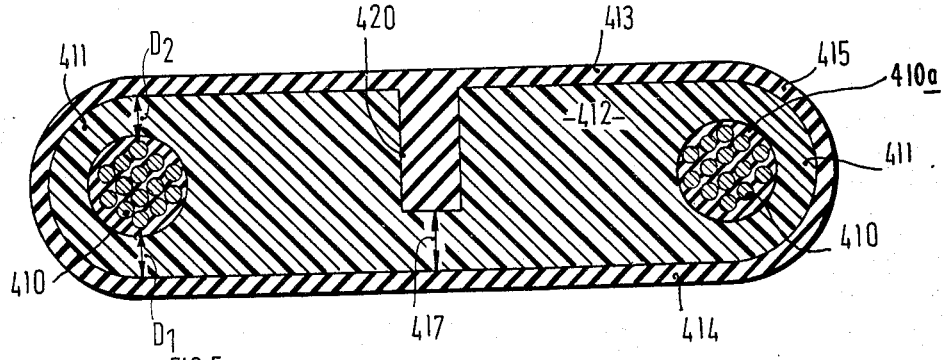
FIG. 5 is a similar view through a fifth embodiment of the invention.

Referring now to FIG. 5 an alternative embodiment of the invention relating to that of FIG. 4 is shown which again comprises electrode wires 410 surrounded by electrically conductive rubber 410*a*, 411 whilst the main body of the tape is indicated at 412 and the material of which the parts 410*a*, 411 and 412 are made is as described hereinbefore.

In this example a single groove 420 extends inwardly in the transverse direction of the section from the side surface 413 and affords a current limiting portion 417 between the bottom end of the groove 420 and the other side surface 414 since the thickness of the portion 417 is less than the sum of the thickness $D_1+D_2$.

The tape is again encompassed in a sheath of insulating rubber 415 which extends into the groove 420.

Figure 6:
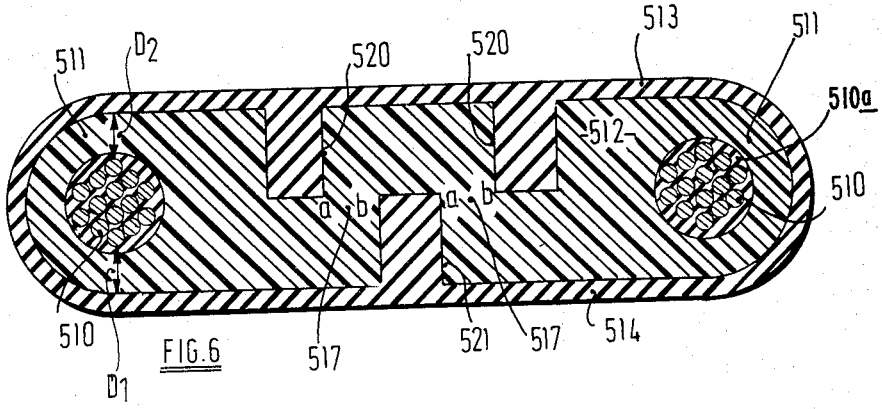
FIG. 6 is a similar view through a sixth embodiment of the invention.

Referring now to FIG. 6, a further modification is shown and in this case the tape comprises wire electrodes 510 surrounded by electrically conductive rubber 510*a*, 511 whilst the main body of the tape 512 again has generally planar side surfaces 513 and 514. The material of the parts 510*a*, 511 and 512 is as described in the previous embodiments. In this embodiment however two grooves 520 are provided at longitudinally spaced apart positions of the transverse section of the tape, which extend transversely inwardly from the surface 513 towards the other surface 514 whilst longitudinally between the two grooves 520 is provided a further groove 521 which extends transversely inwardly from the surface 514 towards the surface 513. Thus in this case the current limiting portions are as indicated at 517 and in this case their dimension in the longitudinal direction of the section is significant i.e. the sum of the distances a−b is less than the sum of the thickness $D_1+D_2$.

If desired more than 3 grooves may be provided. It will be appreciated that the cross section of the groove may be other than the rectangular configuration described hereinbefore.

The groove or grooves of the embodiments of FIGS. 4 to 6 could also be filled with a thermally conductive material to improve heat dissipation from the tape, or alternatively, the grooves could be filled with a material of lower conductivity than the main body of the tape in order to modify the overall conductivity.

Although circular wire elements have been described in the above examples the electrodes may be of other shape such as strips or foil as can be electrically conductive wires 218.

In all the embodiments described and illustrated above the electrodes are embedded in a thin case of electrically conductive rubber 10*a*, 110*a*, 310*a*, 410*a*, 510*a*. This may be the same material as the electrode surrounding and main, body parts or may be of different material, for example, material of greater electrical conductivity than the electrode surrounding and main, body parts such as the material described in our copending application claiming priority from U.K. patent application No. 20418/78.

If desired, however, the electrodes may be embedded directly into the material of the body.

It should also be appreciated that combinations of the embodiments described hereinbefore may be provided.

We claim:

1. A heating tape comprising a flat heating body of electrically conductive material and at least two spaced apart elongate generally parallel electrodes embedded directly in said body so that the surfaces of the electrodes are in electrically conductive relationship with said body, wherein said body, between the electrodes, has parallel spaced apart planar side surface portions and is of constant thickness except for at least one narrow groove in the electrically conductive material between the electrodes, the groove extending into the tape from one of said surface portions and extending longitudinally of the tape generally parallel to said electrodes so as to provide a region of smallest cross-sectional dimension of the body between the electrodes smaller than the maximum effective cross-sectional dimension of the electrodes, the distance between each lateral boundary of the groove and the electrode nearest thereto being greater than the width of the groove, the tape being coated with an electrically insulating material which occupies said groove, and the highest current density in the effective current path between the electrodes is in the region of the smallest cross-sectional dimension of the heating body.

2. A heating tape according to claim 1 wherein said smallest cross sectional dimension of the body is not more than 60% of the maximum effective cross sectional dimension of the electrodes.

3. A tape according to claim 1 wherein the electrodes each comprise a wire conductor embedded directly in the material of said body.

4. A tape according to claim 1 wherein the electrodes each comprise a wire conductor coated with electrically conductive material, of greater electrical conductivity than the material of the body, the coated electrodes being embedded in the material of said body.

5. A tape according to claim 1 wherein a single groove is provided extending transversely inwardly from one side surface of the tape to a position adjacent the other side surface and spaced inwardly thereof.

6. A heating tape comprising a flat heating body of electrically conductive material comprising silicone rubber having dispersed therein particles of carbon black, and at least two spaced apart elongate generally parallel electrodes embedded directly in said body so that the surface of the electrodes are in electrically conductive relationship with said body, wherein said body has edge electrode surrounding portions of semi-cylindrical configuration and, between the electrodes, parallel spaced apart planar side surface portions and is of constant thickness except for a narrow groove in the electrically conductive material between the electrodes, said groove having parallel planar sides and extending into the tape from one of said side surface portions and extending longitudinally of the tape generally parallel to said electrodes so as to provide a region of smallest cross-sectional dimension of the body between the electrodes which is not more than 60% of the maximum effective cross-sectional dimension of the electrodes, the distance between each lateral boundary of the groove and the electrode nearest thereto being greater than the width of the groove, the tape being coated with an electrically insulating material which occupies said groove, and the highest current density in the effective current path between the electrodes is in the region of the smallest cross-sectional dimension of the heating body.

* * * * *

UNITED STATES PATENT AND TRADEMARK OFFICE

CERTIFICATE OF CORRECTION

PATENT NO. : 4,307,290

DATED : December 22, 1981

INVENTOR(S) : Frederick W. Bloore et al.

It is certified that error appears in the above—identified patent and that said Letters Patent is hereby corrected as shown below:

ON THE TITLE PAGE INSERT:

-- (30) Foregin Application Priority Data

June 15, 1978 Great Britain 26998 --.

Signed and Sealed this

*Thirteenth* Day of *April 1982*

[SEAL]

*Attest:*

GERALD J. MOSSINGHOFF

*Attesting Officer*

*Commissioner of Patents and Trademarks*